United States Patent [19]

Callaghan

[11] 4,156,370

[45] May 29, 1979

[54] DUAL CONTROL SYSTEM FOR TRANSMISSIONS

[75] Inventor: William I. Callaghan, Mentor, Ohio

[73] Assignee: Towmotor Corporation, Mentor, Ohio

[21] Appl. No.: 852,886

[22] Filed: Nov. 18, 1977

[51] Int. Cl.[2] ..... G05G 11/00; G05G 1/14

[52] U.S. Cl. ..... 74/481; 74/470; 74/474

[58] Field of Search ..... 74/470, 474, 478, 481, 74/482, 512, 513

[56] References Cited

U.S. PATENT DOCUMENTS

| | | | |
|---|---|---|---|
| 3,316,773 | 5/1967 | Findlay | 74/481 |
| 3,691,863 | 9/1972 | Shaffer | 74/478 |
| 4,011,768 | 3/1977 | Tessenske | 74/481 |
| 4,040,306 | 8/1977 | Jensen | 74/481 X |

*Primary Examiner*—Allan D. Herrmann
*Attorney, Agent, or Firm*—Phillips, Moore, Weissenberger, Lempio & Majestic

[57] ABSTRACT

A reciprocal control member for a transmission is pivotally connected to a rotatable sleeve for selectively placing the transmission in its neutral, forward or reverse modes of operation. A hand lever is connected to the sleeve to rotate it to place the transmission in a selected mode of operation and to simultaneously control the speed thereof. A foot pedal is adapted to be depressed to control the output speed of the transmission by overriding the first input control when the first input control is either in its forward or reverse position of operation. The foot pedal is connected to the sleeve by a pair of pin and slot connections for inducing rotation of the sleeve upon movement of the foot pedal in either direction.

21 Claims, 12 Drawing Figures

LEVER 13 (N)
PEDAL 42 (UP)

LEVER 13 (N)
PEDAL 42 (DOWN)

LEVER 13 (FOR.)
PEDAL 42 (DOWN)

LEVER 13 (FOR.)
PEDAL 42 (UP)

LEVER 13 (REV.)
PEDAL 42 (DOWN)

LEVER 13 (REV.)
PEDAL 42 (UP)

DUAL CONTROL SYSTEM FOR TRANSMISSIONS

BACKGROUND OF THE INVENTION

This invention relates to a dual control system for a transmission, such as a hydrostatic transmission, whereby the transmission may be placed in its forward or reverse mode of operation and have the speed thereof simultaneously controlled by an operator of a vehicle.

Transmission control systems of this type require operator input means for shifting the transmission into its neutral, forward or reverse modes of operation and for also controlling the speed of the transmission and engine. The operator input means normally comprises a plurality of foot pedals and/or hand levers adapted to be controlled simultaneously by the operator of a vehicle. For example, U.S. Pat. No. 3,691,863, assigned to the assignee of this application, discloses such a control system wherein a hand lever is adapted to place a transmission in its forward or reverse mode of operation and a foot pedal controls the speed of the transmission.

It is desirable to arrange the actuating linkages and attendant mechanisms for control systems of this type in a compact and protected manner and to further provide a high degree of structural integrity to the system. The system must also exhibit the capability of quickly responding to an operator's input signal to, in turn, precisely and quickly condition the transmission for a selected mode of operation.

The above-referenced patent, for example, discloses a workable system wherein numerous linkages and rods are reciprocally and slidably mounted therein to provide a substantial number of wear points in the system. In addition, the integrated system is somewhat bulky and cannot be readily bench assembled for expeditious installation on a vehicle.

SUMMARY OF THE INVENTION

The present invention is directed to overcoming one or more of the problems as set forth above.

The transmission control system of this invention comprises an improved transmission control means for selectively placing a transmission in a neutral, forward or reverse mode of operation and for simultaneously varying the speed of the transmission. The system is compact, exhibits a minimal number of wear points and is adapted to be bench-assembled for expeditious mounting on a vehicle.

The transmission control system comprises first input means movable between neutral, forward and reverse positions. A first actuating means, including a rotatable sleeve, connects the first input means to a transmission control means for selectively placing the transmission in a selected mode of operation and for varying the output speed of the transmission when the first input means is moved from its neutral position towards its forward or reverse positions.

A second input means, movable between maximum and minimum speed positions, is interconnected between the sleeve and second actuating means. The second actuating means, including pin and slot connection means connected to the sleeve for inducing rotation thereof upon movement of the second input means in either direction, selectively varies the speed of the transmission only when the transmission is placed in its forward or reverse modes of operation in response to movement of the second input means between its maximum and minimum speed positions. Thus, the output speed of the transmission can be controlled by either the first or second input means and the second input means is adapted to override the first input means to control the speed of the transmission.

BRIEF DESCRIPTION OF THE DRAWINGS

Other objects of this invention will become apparent from the following description and accompanying drawings wherein.

DETAILED DESCRIPTION

Figure 1:
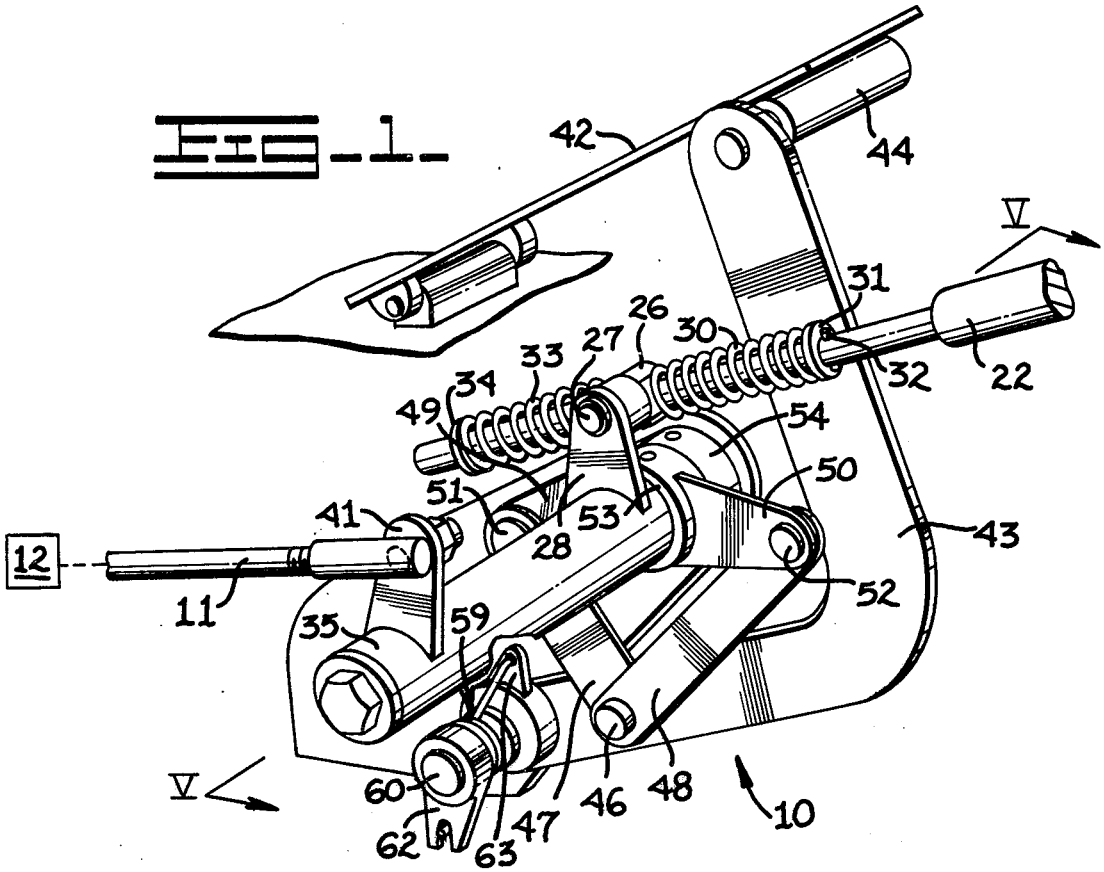
FIG. 1 is an isometric view partially illustrating a dual control system for a transmission, embodying this invention.

FIG. 1 partially illustrates a transmission control system 10 comprising a reciprocal rod 11 constituting a transmission control means for selectively placing a transmission 12 in a neutral, forward or reverse mode of operation and for simultaneously varying the speed thereof. The rod may be suitably connected to the valve spool (not shown) of a conventional hydraulic circuit for controlling actuation of the transmission. The transmission may be of any well-known type, such as hydrostatic or clutch-engaged.

Figure 2:
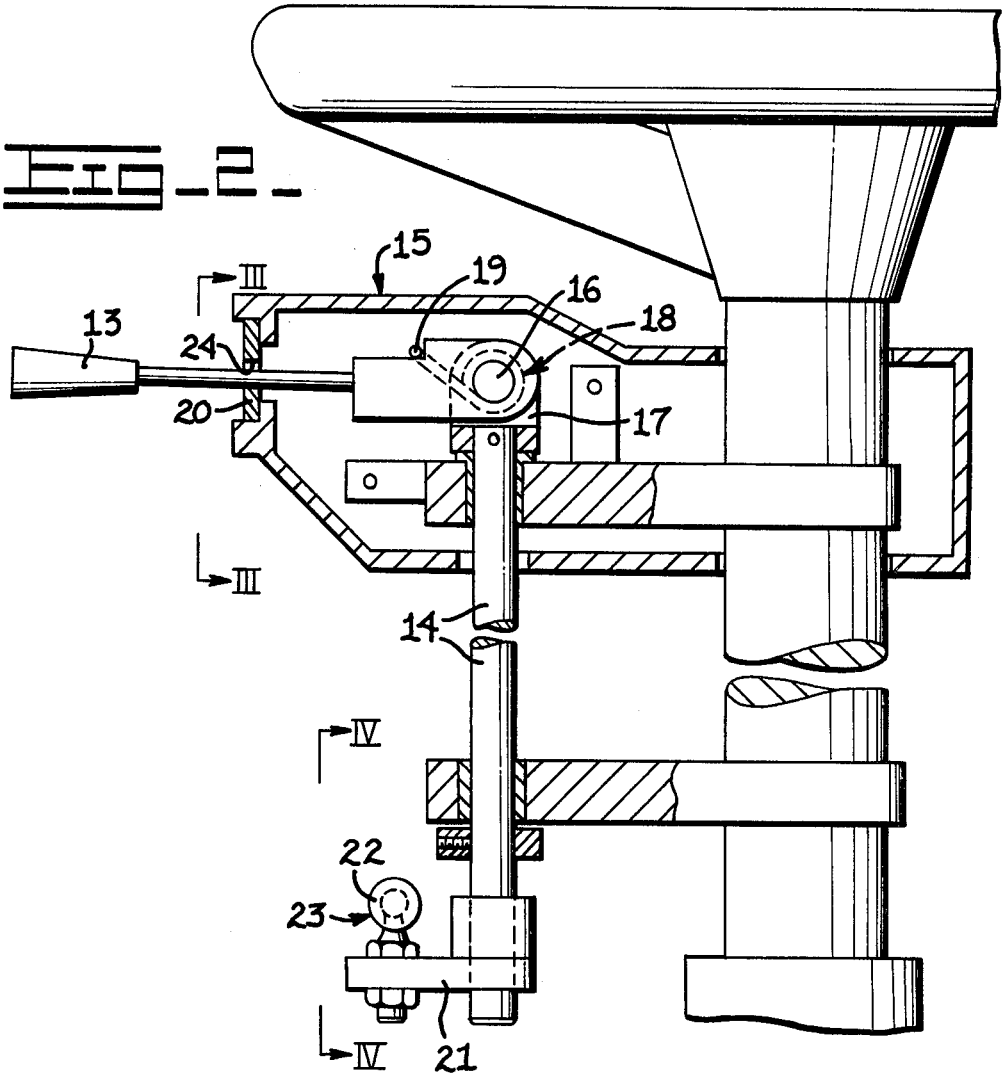
FIG. 2 is a side elevational and partially sectioned view of a steering column for a vehicle having a hand lever of the control system mounted thereon.
Figure 3:
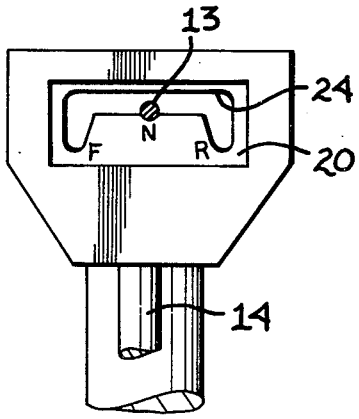
FIG. 3 is a side elevational view, taken in the direction of arrows III—III in FIG. 2, illustrating a slotted plate for positioning the hand lever thereon.
Figure 4:
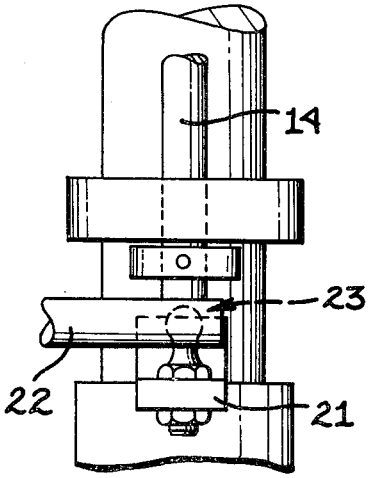
FIG. 4 is a side elevational view, taken in the direction of arrows IV—IV in FIG. 2.

Referring to FIGS. 2–4, a first input means, movable between neutral (N), forward (F), and reverse (R) positions of operation, preferably comprises a hand lever 13 suitably mounted on a steering column of a vehicle for ready access by the operator. As will be hereinafter more fully described, the lever is adapted for movement between its neutral, forward and reverse positions to selectively reciprocate rod 11 (FIG. 1) to place transmission 12 in its neutral, forward or reverse mode of operation, respectively. The first input means further comprises a shaft 14 rotatably mounted on a stationary bracket assembly 15 suitably secured to the steering column.

Lever 13 is pivotally mounted by a pin 16 on a bifurcated bracket 17 secured to an upper end of shaft 14. A torsion spring 18 has its coils mounted on the pin and has a first end thereof (not shown) anchored to bracket 17 and a second end 19 overlying lever 13 to bias it counterclockwise in FIG. 2. As shown in FIG. 3, the spring thus biases the hand lever downwardly into engagement with one of three notches formed in a plate 20, such notches defining the neutral (N), forward (F) and reverse (R) positions of the lever.

As further shown in FIGS. 2 and 4, a lower end of shaft 14 is secured to a lever 21 to thus form a bellcrank with lever 13 and shaft 14. A rod 22, also forming part of the first input means, is pivotally connected to lever 21 by a ball and socket connection 23. Thus, sliding movements of hand lever 13 in a slot 24 (FIG. 3) formed through plate 20 will, in turn, reciprocate rod 22.

Figure 5:
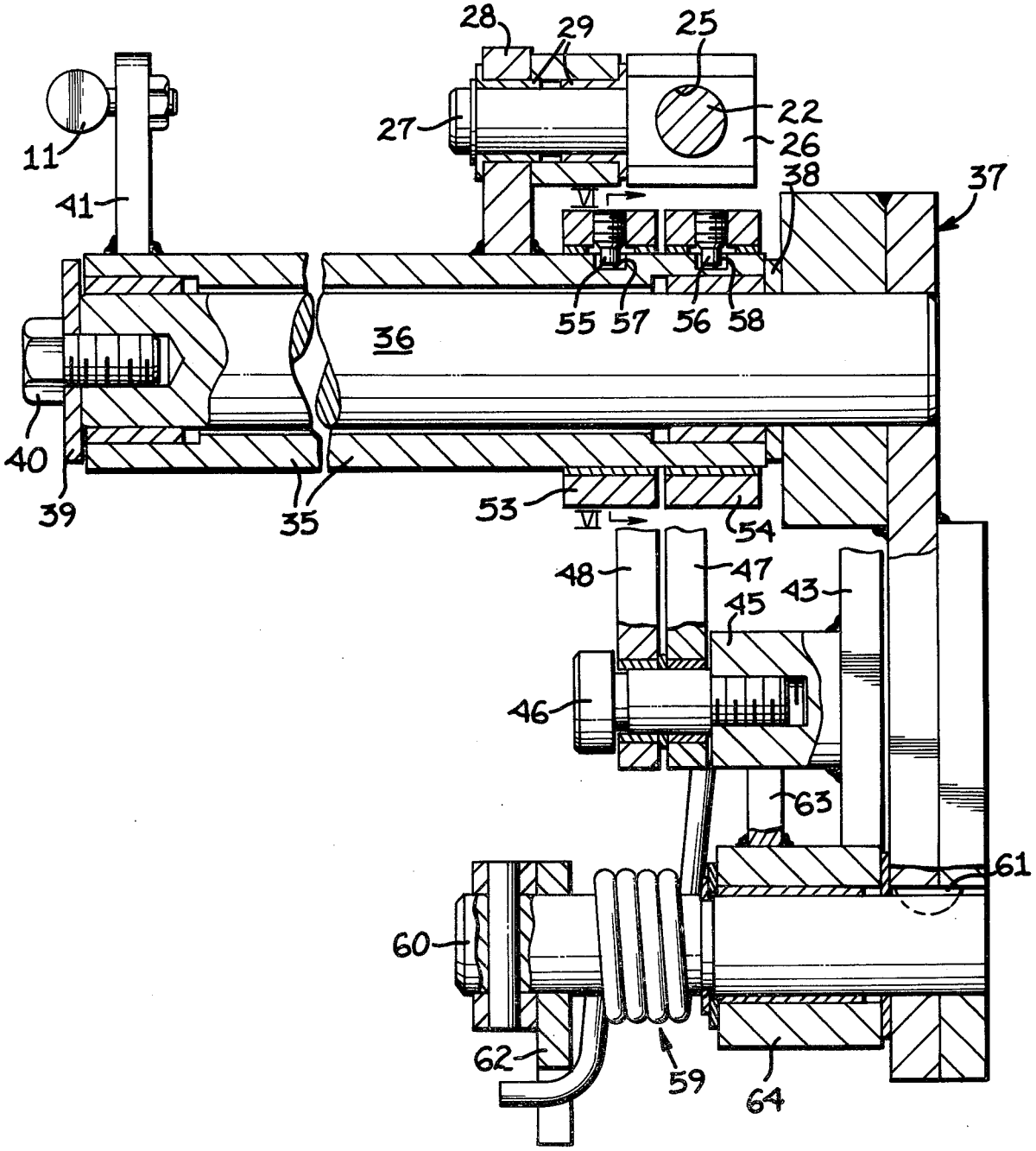
FIG. 5 is an enlarged sectional view through the control system, generally taken in the direction of arrows V—V in FIG. 1.

Referring to FIGS. 1 and 5, rod 22 has its opposite end slidably mounted in a bore 25 formed through a bracket 26. A pin 27, secured to the bracket, is pivotally mounted on a lever 28 by sleeve bearings 29. A first compression coil spring 30 is mounted between bracket 26 and a washer 31 secured in place on rod 22 by a pin 32.

A second compression coil spring 33 is mounted between an opposite side of bracket 26 and a washer 34, also suitably secured to rod 22. Thus, springs 30 and 33 cooperate to provide self-centering biasing means for rod 22 functioning to return hand lever 13 (FIG. 2) to its neutral position automatically upon release of the hand lever and when it is disengaged from a respective one of the notches formed in plate 20. The springs further function to provide a loss-motion means whereby pivotal movements imparted to lever 28 will not affect the position of the hand lever upon the latter's engagement with the forward (F) or reverse (R) notch formed in plate 20 (FIG. 3).

Lever 28 is suitably secured to a sleeve 35 rotatably mounted on a shaft 36, secured to a stationary support bracket 37. A first thrust washer 38 is disposed between the bracket and the sleeve whereas a second thrust washer 39 is secured on an end of the shaft by a bolt 40 to center the sleeve on the shaft. A second lever 41 is suitably secured on an outer end of sleeve 35 in axially spaced relationship relative to lever 28 and is pivotally connected to rod 11 by a standard ball and socket connection (not shown). Levers 28 and 41 and sleeve 35 thus comprise first actuating means connecting hand lever 13 of the first input means to rod 11 of the transmission control means.

From the above description it can be seen that movement of hand lever 13 from its illustrated neutral position to either its forward or reverse position will reciprocate rod 22, rotate sleeve 35 and reciprocate rod 11 to place transmission 12 in either its forward or reverse condition of operation. It should be understood that when the lever is moved from its neutral (N) towards either its forward (F) or reverse (R) position, that the output speed of the transmission will vary under the control of the operator.

Figure 6:
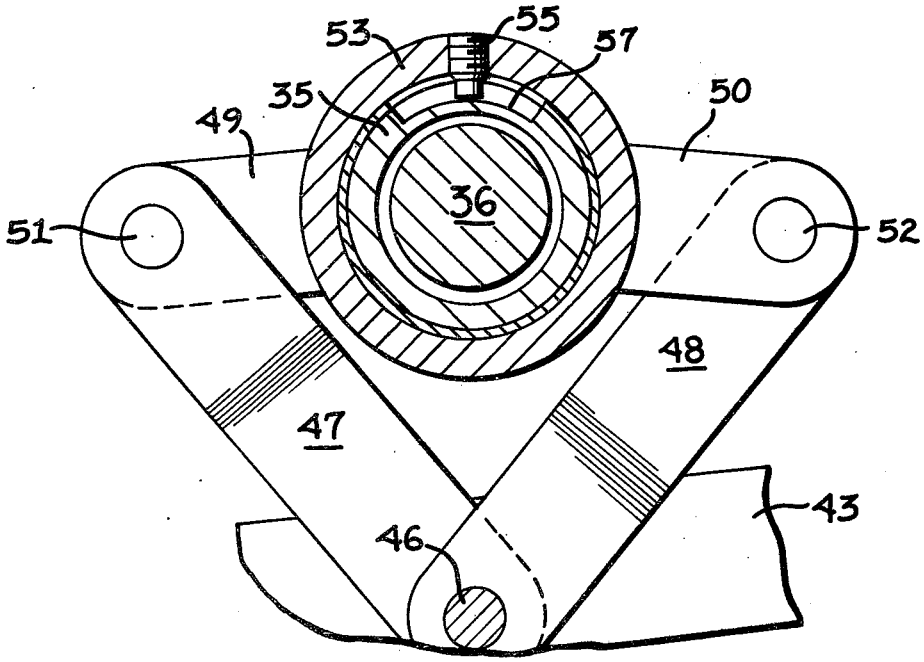
FIG. 6 is an enlarged sectional view, taken in the direction of arrows VI—VI in FIG. 5.

FIGS. 1, 5 and 6 further illustrate a second input means, preferably comprising a foot pedal 42, pivotally movable between a depressed minimum (zero) speed position and the illustrated raised maximum speed position of operation. The second input means further comprises a control lever 43 having a roller 44 rotatably mounted on one end thereof to underly the pedal. The opposite end of the lever is secured to a boss 45 having a pin 46 detachably connected thereto. The lever is generally L-shaped to partially circumvent sleeve 35 to aid in providing a compact linkage system for the transmission control system.

Second actuating means operatively connecting the lever to sleeve 35 comprises a pair of first and second links 47 and 48 having first ends thereof pivotally mounted on pin 46 and having second ends thereof pivotally mounted on levers 49 and 50 by pins 51 and 52, respectively. Levers 49 and 50 are respectively secured to collars 53 and 54 which are rotatably mounted on sleeve 35. As clearly shown in FIGS. 5 and 6, pins 55 and 56 are threadably attached to collars 53 and 54, respectively.

Figure 7:
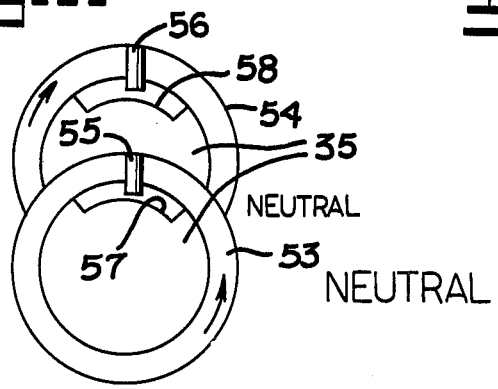
FIGS. 7–12 schematically illustrate operative positions of pin and slot means employed in the control system during operation thereof.

Pins 55 and 56 extend radially inwardly from the collars and are disposed within slots 57 and 58, respectively, formed circumferentially on the periphery of sleeve 35. FIGS. 6 and 7 illustrate the circumferential dispositions of the slots on the collars and the relative dispositions of the slots when the transmission control system is maintained in its illustrated neutral and zero speed condition of operation. As will be hereinafter more fully described, pins 55 and 56 and accommodating slots 57 and 58 form pin and slot connection means of the second actuating means, connected to sleeve 35 of the first actuating means.

FIGS. 1 and 5 further illustrate biasing or return spring means in the form of a torsion spring 59 for biasing pedal 42 to its illustrated raised or maximum speed position of operation. The coils of the spring are mounted on a stub shaft 60 suitably secured to bracket 37 by a key 61. A first end of the spring is anchored to a bracket 62 secured to shaft 60 whereas a second end of the spring is secured to a lug 63 secured to a hub 64, rotatably mounted on the shaft and having lever 43 secured thereto. Thus, selective depression of pedal 42 and lever 43 about shaft 60 will move pin 46 and levers 47 and 48 downwardly in FIG. 1 to pivot levers 49 and 50 in opposite directions.

Figure 8:
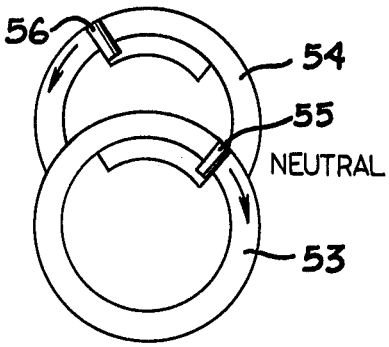

In operation, a vehicle operator may control the speed of transmission 12 by hand lever 13 (FIG. 2) or by foot pedal 42 (FIG. 1). Unless the hand lever is either placed in its full forward (F) or reverse (R) position of operation, manipulation of pedal 42 will have no effect on the speed of the transmission, i.e., the above described pin and slot connection means will function as a lost-motion connection whereby pivotal movement of the pedal will not impart rotary motion to sleeve 35. This lost-motion function is best shown in FIGS. 7 and 8 which illustrate the dispositions of pins 55 and 56 relative to slots 57 and 58, respectively, when lever 13 is retained in neutral and pedal 42 is either raised or depressed.

Figure 9:
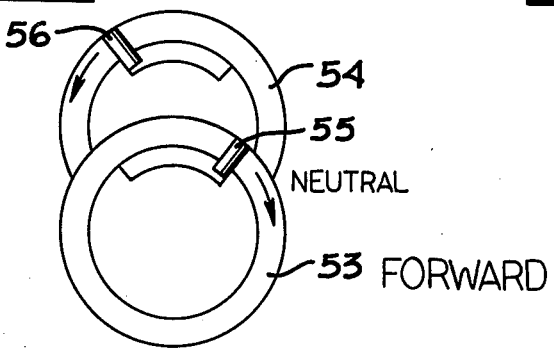
Figure 10:
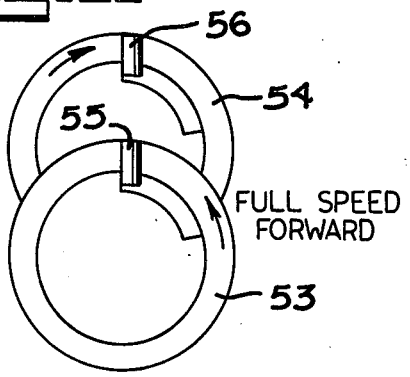

When the operator shifts lever 13 towards its forward position (FIG. 3), rod 22 will move generally leftwardly in FIG. 1 to, in turn, rotate sleeve 35 generally counterclockwise. Springs 30 and 33 are sufficiently stiff to permit such rotation of the sleeve. Thus, rod 11 reciprocates to vary the forward speed of the transmission to a maximum speed condition dictated by the notch F position of hand lever 13 in FIG. 3. Should the operator desire to reduce the speed of the transmission without moving the hand lever from its F position, he need only depress pedal 42 whereby rod 11 (FIG. 1) will be reciprocated rightwardly a preselected amount. FIGS. 9 and 10 illustrate the relative dispositions of pins 55 and 56 in their respective slots when the lever is retained in its forward (F) position and the pedal is pivoted fully downwardly and raised fully upwardly, respectively.

Figure 11:
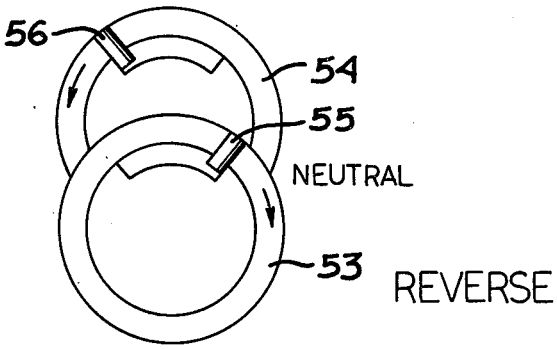
Figure 12:
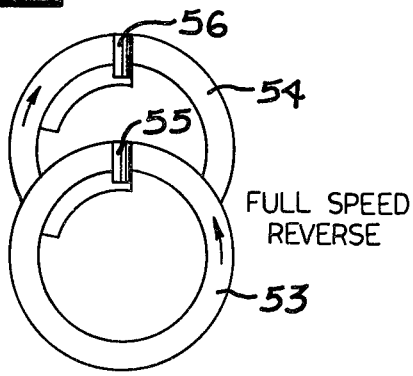

When the operator moves hand lever 13 to its reverse (R) position in FIG. 3, the latter sequence of operations are substantially duplicated in a reverse manner. In particular, rod 27 will move generally rightwardly in FIG. 1, sleeve 35 will pivot generally clockwise and rod 11 will reciprocate generally rightwardly. FIG. 11 illustrates the relative dispositions of pins 55 and 56 in their respective slots when the lever is retained in its R position with pedal 42 being positioned fully downwardly at its zero speed position. FIG. 12 illustrates the relative disposition of the pins when the lever is retained in its R position and the pedal is raised fully upwardly to its maximum speed position. Thus, the operator can manipulate the pedal between its two extreme positions to also vary the speed of the transmission when it is retained in its reverse mode of operation.

In view of the above description, it can be seen that the transmission control system embodying this invention is highly efficient in operation and exhibits a high degree of structural integrity and a minimal number of wear points. The compact nature of the system also provides economy and full protection to the working mechanisms against potential damage and exposure to ambient contaminants, such as dirt and debris. In addition, the system may be bench-assembled and tested and requires minimal connections to control rod 11 and hand lever 13 upon its installation in a vehicle.

The embodiments of the invention in which an exclusive property or privilege is claimed are defined as follows:

1. A transmission control system comprising transmission control means for selectively placing a transmission in a neutral, forward or reverse mode of operation and for simultaneously varying the output speed of said transmission when placed in its forward or reverse mode of operation, first input means including a hand lever movably mounted on a stationary bracket for movement between neutral, forward and reverse positions and a rod connected to said hand lever for reciprocation thereby, first actuating means, including a rotatable sleeve having said rod reciprocally mounted thereon, connecting said first input means to said transmission control means for selectively placing said transmission in its neutral, forward or reverse mode of operation in response to movement of said hand lever to its natural, forward or reverse position, respectively, and for varying the speed of said transmission when said hand lever is moved from its neutral towards its forward or reverse position, second input means movable between minimum and maximum speed positions, and second actuating means, including pin and slot connection means connected to the sleeve of said first actuating means for inducing rotation of said sleeve upon movement of said second input means in either direction, for selectively varying the speed of said transmission only when said transmission is placed in its forward or reverse mode of operation in response to movement of said second actuating means between its minimum and maximum speed positions whereby the speed of said transmission can be controlled by either said first or second input means.

2. The transmission control system of claim 1 wherein said sleeve is rotatably mounted on a shaft secured to a stationary bracket and wherein said rod is pivotally connected to a lever secured to said sleeve.

3. The transmission control system of claim 1 wherein said rod is reciprocally mounted on a bracket secured to said sleeve and further comprising biasing means operatively interconnected between said bracket and said rod for normally urging said hand lever to its neutral position.

4. The transmission control system of claim 3 wherein said biasing means comprises a pair of coil springs mounted on said rod and disposed on either side of said bracket.

5. The transmission control system of claim 1 wherein said second input means comprises a foot pedal pivotally mounted on a stationary support and a control lever having one end thereof pivotally mounted on a stationary support bracket and a second end thereof engageable with said foot pedal.

6. The transmission control system of claim 5 wherein said control lever is generally L-shaped and has a roller rotatably mounted on the second end thereof and engageable beneath said foot pedal.

7. The transmission control system of claim 5 further comprising biasing means for normally biasing said control lever and said foot pedal to raised positions.

8. The transmission control system of claim 5 wherein said second actuating means comprises first and second levers pivotally mounted on said sleeve and linkage means pivotally interconnecting said first and second levers with said control lever.

9. The transmission control system of claim 8 wherein said first and second levers are secured to first and second collars, respectively, each rotatably mounted on said sleeve and wherein said pin and slot connection means comprises a pin secured to each of said first and second collars and a pair of grooves formed circumferentially on said sleeve and having each said pin disposed therein.

10. A linkage system adapted for use in a control system or the like comprising a rotatable sleeve, output means connected to said sleeve for movement in opposite directions in response to rotation of said sleeve, first input means connected to said sleeve, including a rod reciprocally mounted on said sleeve, for rotating said sleeve in opposite directions in response to movement of said first input means in opposite directions, second input means movably mounted adjacent to said sleeve for movement in opposite directions, and actuating means, including pin and slot connection means, interconnected between said sleeve and said second input means for inducing rotation of said sleeve upon movement of said second input means in either direction.

11. The linkage system of claim 10 wherein said sleeve is rotatably mounted on a shaft secured to a stationary bracket and wherein said output means comprises a rod pivotally connected to a bracket secured to said sleeve.

12. The linkage system of claim 10 wherein said rod is reciprocally mounted on a bracket secured to said sleeve and further comprising biasing means operatively interconnected between said bracket and said rod for normally urging said rod to a neutral position.

13. The linkage system of claim 12 wherein said biasing means comprises a pair of coil springs mounted on said rod and disposed on either side of said bracket.

14. The linkage system of claim 10 wherein said second input means comprises a control lever having an end thereof pivotally mounted on a stationary support bracket.

15. The linkage system of claim 14 wherein said control lever is generally L-shaped and partially circumvents said sleeve.

16. The linkage system of claim 14 further comprising biasing means for normally biasing said control lever to a raised position.

17. The linkage system of claim 14 wherein said actuating means comprises first and second levers pivotally mounted on said sleeve and linkage means pivotally interconnecting said first and second levers with said control lever.

18. The linkage system of claim 17 wherein said first and second levers are secured to first and second collars, respectively, rotatably mounted on said sleeve and wherein said pin and slot connection means comprises a pin secured to each of said first and second collars and a pair of grooves formed circumferentially on said sleeve and having each said pin disposed therein.

19. A transmission control system comprising transmission control means for selectively placing a transmission in a neutral, forward or reverse mode of operation and for simultaneously varying the output speed of said transmission when placed in its forward or reverse mode of operation, first input means movable between neutral, forward and reverse positions, first actuating means, including a rotatable sleeve, connecting said first input means to said transmission control means for selectively placing said transmission in its neutral, forward or reverse mode of operation in response to movement of said first input means to its neutral, forward or reverse position, respectively, and for varying the speed of said transmission when said first input means is moved from its neutral towards its forward or reverse position, second input means, including a foot pedal pivotally mounted on a stationary support and a control lever having one end thereof pivotally mounted on a stationary support bracket and a second end thereof engageable with said foot pedal, movable between minimum and maximum speed positions, and second actuating means, including pin and slot connection means connected to the sleeve of said first actuating means for inducing rotation of said sleeve upon movement of said second input means in either direction, for selectively varying the speed of said transmission only when said transmission is placed in its forward or reverse mode of operation in response to movement of said second actuating means between its minimum and maximum speed positions whereby the speed of said transmission can be controlled by either said first or second input means.

20. A linkage system adapted for use in a control system or the like comprising a rotatable sleeve, output means connected to said sleeve for movement in opposite directions in response to rotation of said sleeve, first input means connected to said sleeve for rotating said sleeve in opposite directions in response to movement of said first input means in opposite directions, second input means, including a control lever having an end thereof pivotally mounted on a stationary support bracket and wherein said control lever is generally L-shaped and partially circumvents said sleeve, movably mounted adjacent to said sleeve for movement in opposite directions, and actuating means, including pin and slot connection means, interconnected between said sleeve and said second input means for inducing rotation of said sleeve upon movement of said second input means in either direction.

21. A linkage system adapted for use in a control system or the like comprising a rotatable sleeve, output means connected to said sleeve for movement in opposite directions in response to rotation of said sleeve, first input means connected to said sleeve for rotating said sleeve in opposite directions in response to movement of said first input means in opposite directions, second input means, including a control lever having an end thereof pivotally mounted on a stationary support bracket, movably mounted adjacent to said sleeve for movement in opposite directions, and actuating means, including pin and slot connection means, interconnected between said sleeve and said second input means for inducing rotation of said sleeve upon movement of said second input means in either direction, said actuating means further including first and second levers pivotally mounted on said sleeve and linkage means pivotally interconnecting said first and second levers with said control lever.

* * * * *